US008664172B2

(12) United States Patent
Veltman et al.

(10) Patent No.: US 8,664,172 B2
(45) **Date of Patent: *Mar. 4, 2014**

(54) SELF-STICKING DISINTEGRATING BLOCK FOR TOILET OR URINAL

(75) Inventors: Jerome J. Veltman, Racine, WI (US); Michael E. Klinkhammer, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 821 days.

This patent is subject to a terminal disclaimer.

(21) Appl. No.: 12/692,158

(22) Filed: Jan. 22, 2010

(65) Prior Publication Data

US 2010/0120648 A1 May 13, 2010

Related U.S. Application Data

(63) Continuation of application No. 11/673,661, filed on Feb. 12, 2007, now Pat. No. 7,709,433.

(51) Int. Cl.
*C11D 3/37* (2006.01)

(52) U.S. Cl.
USPC ..... 510/191; 510/190; 510/192; 510/445; 510/446; 510/447; 134/22.19

(58) Field of Classification Search
USPC ..... 510/191, 192, 445, 446, 447; 134/22.19
See application file for complete search history.

(56) References Cited

U.S. PATENT DOCUMENTS

| | | | | |
|---|---|---|---|---|
| 3,896,057 | A | 7/1975 | Lindsay et al. | |
| 4,269,723 | A | 5/1981 | Barford et al. | |
| 4,396,522 | A | 8/1983 | Callicott et al. | |
| 4,477,363 | A | 10/1984 | Wong et al. | |
| 4,565,647 | A * | 1/1986 | Llenado | 516/14 |
| 4,722,801 | A | 2/1988 | Bunczk et al. | |
| 4,722,802 | A | 2/1988 | Hutchings et al. | |
| 4,738,728 | A | 4/1988 | Barford et al. | |
| 4,777,670 | A | 10/1988 | Klinkhammer et al. | |
| 4,820,449 | A | 4/1989 | Menke et al. | |
| 4,994,266 | A | 2/1991 | Wells | |
| 5,188,755 | A | 2/1993 | Chang | |
| 5,205,955 | A | 4/1993 | Bunczk et al. | |
| 5,336,427 | A | 8/1994 | Bunczk et al. | |
| 5,449,473 | A | 9/1995 | Bunczk et al. | |
| 5,626,931 | A | 5/1997 | Luhmann | |
| 5,760,907 | A | 6/1998 | Basler et al. | |
| 5,780,411 | A * | 7/1998 | Erilli | 510/237 |
| 5,863,876 | A | 1/1999 | Lance-Gomez et al. | |
| 5,945,390 | A * | 8/1999 | Veltman et al. | 510/191 |
| 5,990,061 | A | 11/1999 | Veltman et al. | |
| 6,055,679 | A * | 5/2000 | Goelz et al. | 4/227.6 |
| 6,103,681 | A * | 8/2000 | Chantler et al. | 510/191 |
| 6,184,192 | B1 | 2/2001 | Klinkhammer | |
| 6,192,524 | B1 * | 2/2001 | Black | 4/225.1 |
| 6,211,128 | B1 * | 4/2001 | Black | 510/191 |
| 6,425,406 | B1 * | 7/2002 | Klinkhammer et al. | 134/22.19 |
| D464,107 | S | 10/2002 | Holmes et al. | |
| 6,589,924 | B2 | 7/2003 | Schmidt et al. | |
| 6,667,286 | B1 * | 12/2003 | Dettinger et al. | 510/191 |
| 6,734,155 | B1 | 5/2004 | Herbots et al. | |
| 6,789,552 | B1 | 9/2004 | Robinson et al. | |
| 6,966,720 | B2 | 11/2005 | Moss | |
| 7,084,129 | B1 * | 8/2006 | Smith et al. | 514/53 |
| 7,119,055 | B2 * | 10/2006 | Cheung et al. | 510/418 |
| 2002/0193270 | A1 * | 12/2002 | Cermenati et al. | 510/302 |
| 2003/0083224 | A1 | 5/2003 | Wick et al. | |
| 2004/0216391 | A1 * | 11/2004 | Papadaki et al. | 52/32 |

FOREIGN PATENT DOCUMENTS

| | | | |
|---|---|---|---|
| AU | 617648 | B3 | 10/1991 |
| DE | 4314659 | A1 | 11/1994 |
| EP | 0014979 | B1 | 9/1980 |
| EP | 0073542 | A | 3/1983 |
| EP | 0167210 | A | 1/1986 |
| EP | 0462643 | A | 12/1991 |
| WO | WO92/03532 | A | 3/1992 |
| WO | WO96/28536 | A | 9/1996 |
| WO | WO 03/043906 | | 5/2003 |
| WO | WO 2004/043825 | | 5/2004 |
| WO | WO20081058853 | A1 | 5/2008 |

OTHER PUBLICATIONS

PCT/US2008/001514 International Search Report and Written Opinion dated Jul. 7, 2008 (U.S. Appl. No. 11/673,661).
Shell Chemicals, Neodol 23 Linear Primary Alcohol, Oct. 2005.
Shell Chemicals, Neodol 91 Linear Primary Alcohol, Oct. 2005.

* cited by examiner

*Primary Examiner* — Mark Eashoo
*Assistant Examiner* — M. Reza Asdjodi

(57) ABSTRACT

A self-sticking disintegrating cleansing block to be attached directly to a wall of a toilet bowl or urinal, above the waterline and in the stream of flush water, by pressing the cleansing block to the wall. The cleaning block includes 25% to 99% of a solid surfactant, and 1% to 25% of a liquid component. The cleansing block may include a substrate removably attached to a surface of the cleansing block. In use, the substrate is removed from the cleansing block and the exposed surface of the cleansing block is pressed to a surface in a position above any waterline that is contacted by a rinse liquid that disintegrates the cleansing block. Rinse liquid is then allowed to contact the cleansing block such that an amount of the cleansing block is mixed with rinse fluid to clean the surface or a liquid reservoir adjacent the surface.

12 Claims, 4 Drawing Sheets

FIG. 1
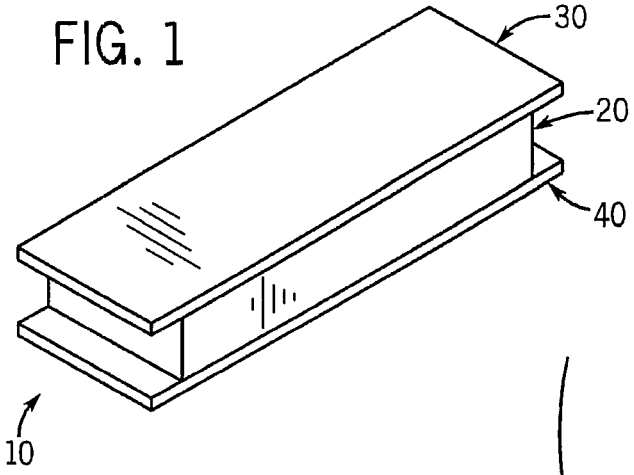
FIG. 2
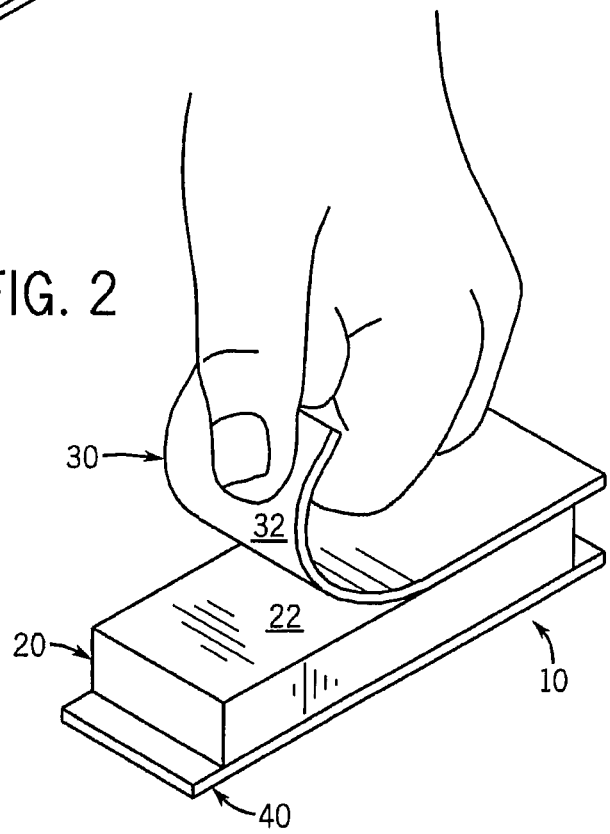
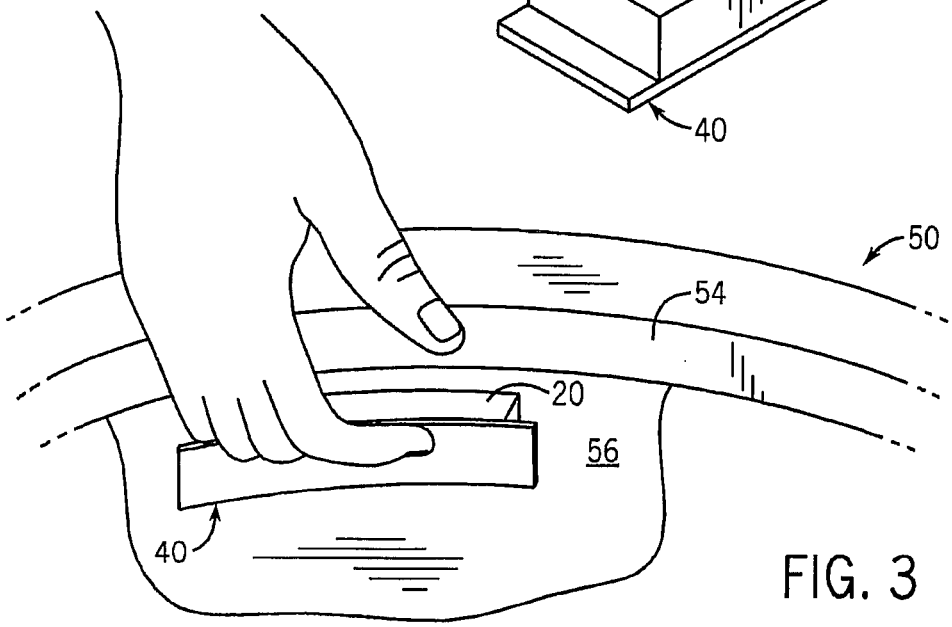
FIG. 3

FIG. 4
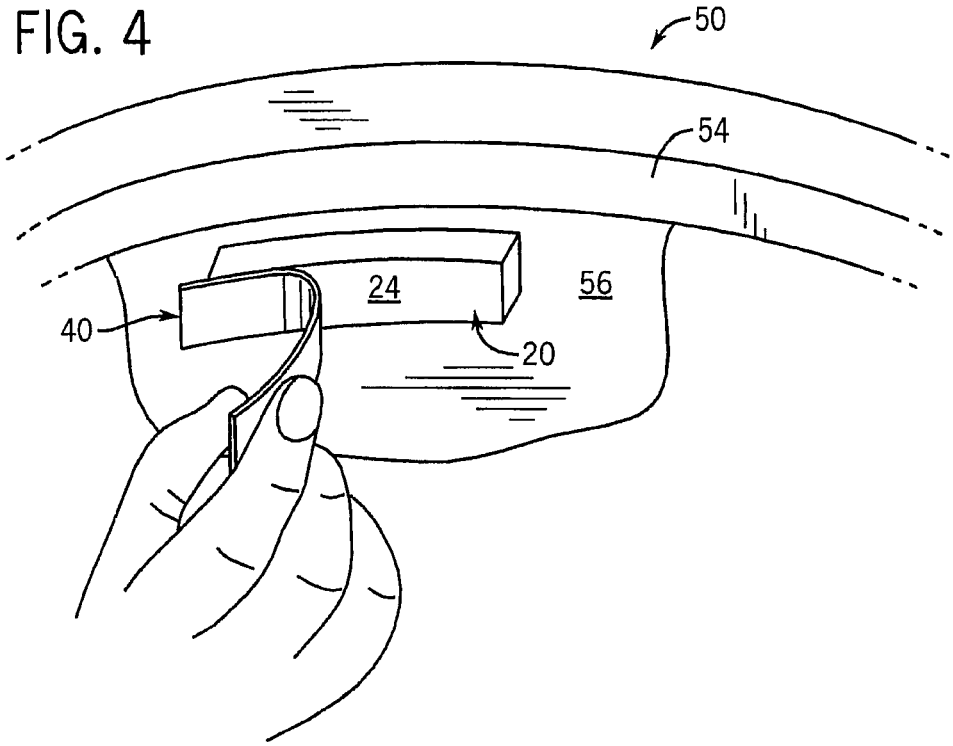
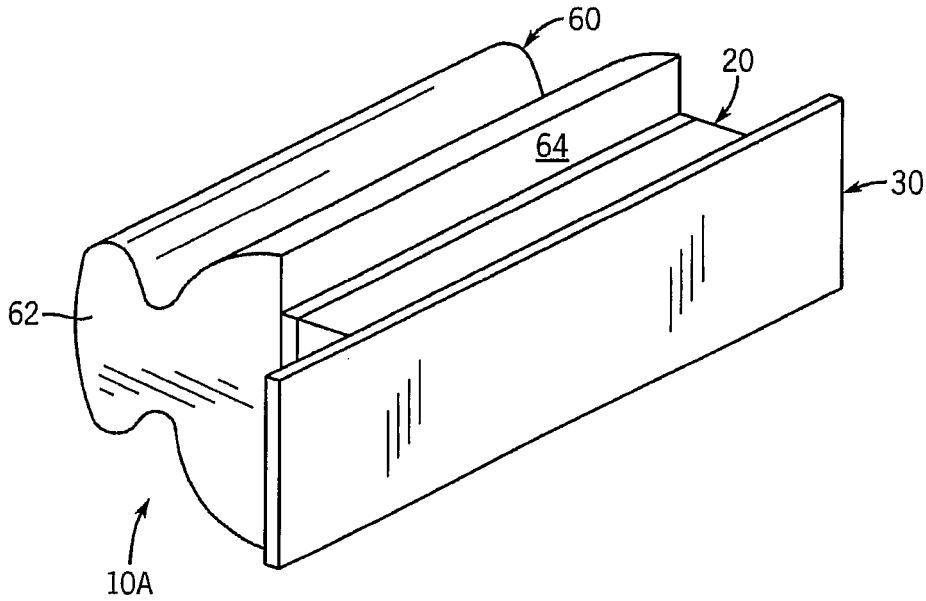
FIG. 5

FIG. 6
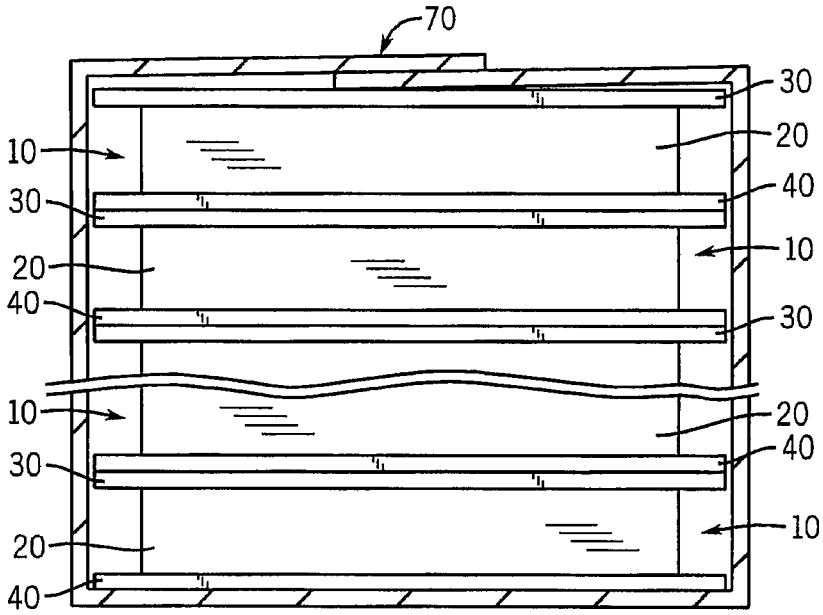
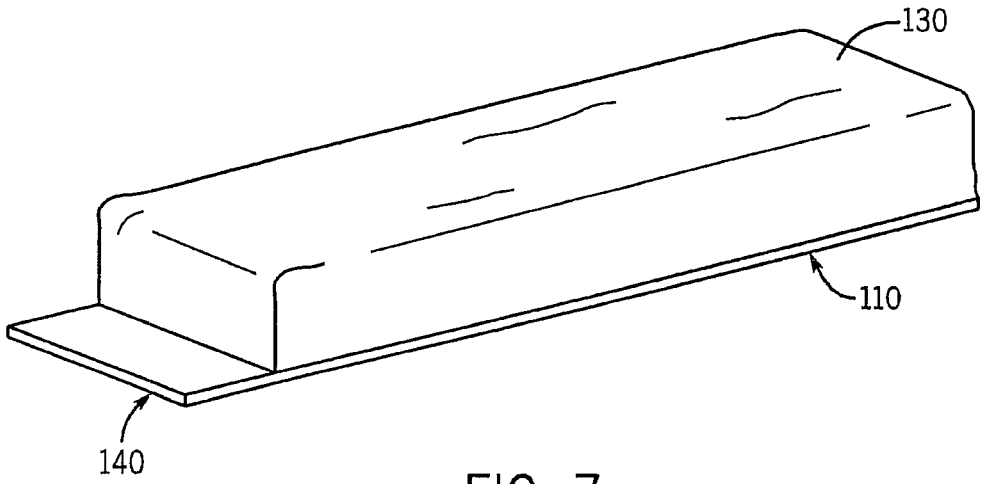
FIG. 7

SELF-STICKING DISINTEGRATING BLOCK FOR TOILET OR URINAL

CROSS-REFERENCES TO RELATED APPLICATIONS

This application is a continuation of application Ser. No. 11/673,661 filed on Feb. 12, 2007.

STATEMENT REGARDING FEDERALLY SPONSORED RESEARCH

Not Applicable.

BACKGROUND OF THE INVENTION

1. Field of the Invention

This invention relates to a self-sticking cleansing block that is applied to a surface such that a rinse liquid disintegrates the cleansing block thereby cleaning, disinfecting and/or deodorizing the surface with active ingredients of the cleansing block. More particularly, this invention relates to a self-sticking disintegrating cleansing block for toilets or urinals.

2. Description of the Related Art

It is known that disintegrating blocks containing various components can be used for cleaning, disinfecting and/or deodorizing toilets or urinals. Such disintegrating blocks generally are immersed in the water tank (also known as the cistern) of a toilet or urinal, or are placed in a holder of some sort and then put "under-the-rim" (UTR) of the toilet bowl or urinal. Once put into place, either in the cistern or in the toilet bowl or urinal, the block slowly releases active ingredients and disintegrates into the water. In the case of a disintegrating block placed into the cistern, the block may fall to the bottom of the cistern, and then constantly be bathed with water. Such constant contact with the water requires a formulation of a certain type to ensure that the disintegrating block releases active ingredients and disintegrates at an appropriate rate. In the case of UTR products, such disintegrating blocks will disintegrate and release active ingredients each time that the toilet is flushed and the block is rinsed with the flush water. Numerous patents have issued relating to the various formulations for such disintegrating blocks.

For example, U.S. Pat. No. 4,477,363 teaches a solid cake comprising a free fatty alcohol; a buffered surfactant; a perfume; a salt; and a dye. The solid cakes are intended to be used in conjunction with a toilet tank dosing dispenser which automatically dispenses a ration of surfactant, perfume, and/or dye, and, optionally, other ingredients to the bowl of a toilet, responsive to the flushing of the toilet.

U.S. Pat. No. 4,820,449 teaches a cleaning block for the tank of flush toilets including sodium monoalkyl sulfate, a fatty acid alkanolamide, and a water-soluble inorganic alkali salt (e.g., sodium sulfate), and, optionally, calcium-complexing carboxylic acids or alkali salts thereof, perfume, dye, antimicrobial agents and other auxiliaries. The block is said to be distinguished by a particularly long useful life, by uniform dissolving behavior and by high cleaning power.

EP 0014979 describes a process for the production of flushing blocks for lavatory hygiene wherein a powder-form or granular mixture having anionic and/or nonionic surfactants; disinfectants or bleaches; an acid; alkaline or neutral salts, solid inorganic or organic acids and/or complexing agents; fillers; dyes and fragrances; binders; and inorganic salts capable of binding water of hydration is brought into contact with water and thereby solidified to form the block.

U.S. Pat. No. 5,863,876 describes a toilet cleansing block containing a polyacrylate polymer and a lauryl benzene sulfonate salt surfactant. The block is for immersion in toilet tanks, and inhibits toilet bowl ring and stain formation, particularly those caused by iron oxide.

U.S. Pat. Nos. 5,945,390 and 5,990,061 describe toilet cleansing blocks that contain an anionic surfactant such as a sulfonate, a linear primary alcohol, and a binder such as hydroxy ethyl cellulose. The block erodes very slowly, yet at essentially identical rates in hard or soft water. The block is for use with a dispenser for immersion in toilet tanks or under the rim of a toilet basin.

U.S. Pat. No. 6,184,192 discloses a toilet cleaning block including a chlorine releasing agent, a stabilizer, a dye, a binder, and an anionic surfactant wherein the chlorine releasing agent, stabilizer, dye, binder, and surfactant are blended together. The binder prolongs life and the stabilizer suppresses adverse interactions between the chlorine releasing agent and the binder, as well as between the chlorine releasing agent and the dye.

Many of the disintegrating blocks described in the patents noted above may be placed into the toilet tank (cistern), either by placing the block into a dispenser, or by simply placing the block in the tank. However, placement of the blocks in the cistern may not be convenient—particularly if the cistern is behind a wall as can occur with some toilet and urinal designs.

It would be much more convenient to be able to place a disintegrating block directly into the toilet bowl or urinal. However, conventional disintegrating blocks must be placed in a holder and then appended to the rim of the toilet bowl. See, for example, the dispensers of U.S. Pat. No. 4,777,670 and D464,107 which are suitable for holding a disintegrating block. The additional need for a holder makes the manufacturing of such an item more complex and more costly. The holder also makes this approach somewhat less environmentally friendly, due to the additional waste that is created.

Alternatives to disintegrating blocks have been proposed. U.S. Pat. No. 6,667,286 describes a viscous gel-like substance that may be applied directly to the inner surface of a toilet bowl for cleaning and/or disinfecting and/or fragrancing the toilet bowl. The substance can be applied from a suitable applicator directly onto the inner surface of the toilet bowl, to which the substance adheres. The substance remains on the inner surface of the toilet bowl even after being contacted with flush water, and typically the substance is only flushed away completely after a large number of flushes. The substance is also suitable for application to other surfaces such as urinals, lavatory or industrial sinks, showers, bathtubs, dishwashing machines and the like.

Various applicators for such adhesive gel-like substances have been proposed. For example, PCT International Patent Application WO 03/043906 discloses a syringe-type dispensing device suitable for use in applying such adhesive gel-like substances to a surface. PCT International Patent Application WO 2004/043825 also discloses a syringe-type dispensing device for applying such adhesive gel-like substances to a surface. While these applicators are believed to succeed in applying the adhesive gel-like substances to a surface, the additional need for an applicator makes the toilet cleaning product more costly.

Thus, there is a need for an under-the-rim disintegrating block that does not require the use of a holder or complex applicator such that the cost and waste associated with the disintegrating block is minimized.

SUMMARY OF THE INVENTION

The foregoing need can be met with a disintegrating cleansing block according to the invention that has a particular formulation so that the block can be directly attached to the inner wall of a toilet bowl or urinal just above the water-line by pressing the block to the wall of the toilet bowl or urinal. When the toilet or urinal is flushed, the cleansing block is rinsed with water. This intermittent rinsing of the cleansing block causes the cleansing block to disintegrate slowly and to release active ingredient. Amazingly, despite the intermittent rinsing of the cleansing block, the cleansing block remains firmly attached to the wall, and can remain so attached for several months. Eventually, the cleansing block disintegrates completely such that there is no longer a cleansing block on the wall of the toilet bowl or urinal. At this point, one can place a new cleansing block on the wall of the toilet bowl or urinal. While the invention finds particular utility in cleansing a toilet bowl or urinal, it is also useful in cleaning, disinfecting and/or deodorizing any surface that is contacted with a rinse liquid.

In one aspect, the invention provides a self-sticking cleansing block that disintegrates in a rinse liquid. The block includes 75% to 99% of a solid surfactant, and 1% to 25% of a liquid component, wherein all percentages are percent by weight of the total composition of the cleansing block. The cleansing block exhibits a degree of stickiness and malleability such that the block may be attached directly to a surface in a position that is contacted by the rinse liquid. Rinsing of the cleansing block by the rinse liquid causes the cleansing block to disintegrate slowly and to release active ingredient on or adjacent the surface.

Preferably, the solid surfactant of the self-sticking cleansing block is selected from the group consisting of alkali metal salts of alkyl, alkenyl and alkylaryl sulfates, alkali metal salts of alkyl, alkenyl and alkylaryl sulfonates, ammonium salts of alkyl, alkenyl and alkylaryl sulfates, and ammonium salts of alkyl, alkenyl and alkylaryl sulfonates. Most preferably, the solid surfactant is selected from the group consisting of alkali metal salts of alkylaryl sulfonates. One example solid surfactant is sodium dodecyl benzene sulfonate. The liquid component may selected from water, surfactants, glycerin, fragrances, colorants, alcohols, binders, chlorine releasing agents, lime-scale removing agents, hydrotropes, solvents, chelating agents, dispersing agents, and mixtures thereof. The cleansing block may further include a filler.

In an example form of the cleansing block, the cleansing block includes 75% to 99% of a solid surfactant, and 1% to 25% of a liquid fragrance. In another example form of the cleansing block, the cleansing block includes 75% to 99% of a solid surfactant, and 1% to 25% of a liquid fragrance, and 1% to 25% of a liquid surfactant. In yet another example form of the cleansing block, the cleansing block includes 75% to 99% of a solid surfactant, and 1% to 25% of a liquid fragrance, and 1% to 25% of a liquid dispersing agent. In still another example form of the cleansing block, the cleansing block includes 75% to 99% of a solid surfactant, and 1% to 25% of a liquid fragrance, and 1% to 25% of a liquid hydrotrope. In yet another example form of the cleansing block, the cleansing block includes 75% to 99% of a solid surfactant, and 1% to 25% of an alcohol such as glycerin.

In another aspect, the invention provides a cleaning article having (i) a sticky cleansing block including a solid surfactant and a liquid component, and (ii) a substrate removably attached to a surface of the cleansing block. In use of the cleaning article, the substrate is removed from the cleansing block and the exposed surface of the cleansing block is pressed in a position above any waterline to a surface that is contacted by a rinse liquid that disintegrates the cleansing block. In a liquid reservoir, the waterline is typically uppermost level of water when the reservoir is filled with liquid. For instance, the waterline in a toilet bowl is the upper level of water after the toilet bowl has completely filled with water following a flush. Rinse liquid is allowed to contact the cleansing block such that an amount of the cleansing block is mixed with rinse fluid to clean the surface or a liquid reservoir adjacent the surface.

In one form, the substrate is a removable film such as a plastic film. In another form, the substrate is a removable handle or a removable flexible handle that provide for ease of application of the block to a curved surface. A second substrate may be removably attached to a second surface of the cleansing block. Also, the first substrate may include a release layer such that less force is required to separate the first substrate from the cleansing block than separate the second substrate from the cleansing block.

In the cleaning article, the cleansing block may include 25% to 99% of a solid surfactant, and 1% to 25% of a liquid component, wherein all percentages are percent by weight of the total composition of the cleansing block. The solid surfactant may be selected from the group consisting of alkali metal salts of alkyl, alkenyl and alkylaryl sulfates, alkali metal salts of alkyl, alkenyl and alkylaryl sulfonates, ammonium salts of alkyl, alkenyl and alkylaryl sulfates, and ammonium salts of alkyl, alkenyl and alkylaryl sulfonates; and the liquid component may be selected from water, surfactants, glycerin, fragrances, colorants, alcohols, binders, chlorine releasing agents, lime-scale removing agents, hydrotropes, solvents, chelating agents, dispersing agents, and mixtures thereof. A filler may be present in the cleansing block.

In one example form, the cleansing block of the cleaning article includes 25% to 99% of the solid surfactant, and 1% to 25% of a liquid fragrance. In another example form, the cleansing block of the cleaning article includes 25% to 99% of the solid surfactant, 1% to 25% of a liquid surfactant, and 1% to 25% of a liquid fragrance. In yet another example form, the cleansing block of the cleaning article includes 25% to 99% of the solid surfactant and 1% to 25% of an alcohol such as glycerin.

In yet another aspect, the invention provides a kit for cleaning a surface or a liquid reservoir adjacent the surface. The kit includes an applicator (optionally with a handle), and a cleansing block including a solid surfactant and a liquid component, wherein the cleansing block is sticky. The cleansing block may include a substrate removably attached to a surface of the cleansing block, and may further include a second substrate removably attached to a second surface of the cleansing block. The cleansing block may include 25% to 99% of a solid surfactant, and 1% to 25% of a liquid component. The cleansing block may include 25% to 99% of a solid surfactant, and 1% to 25% of a liquid fragrance. The cleansing block may include 25% to 99% of a solid surfactant, 1% to 25% of a liquid surfactant, and 1% to 25% of a liquid fragrance.

In still another aspect, the invention provides a method for cleaning a surface or a liquid reservoir adjacent the surface. In the method, a cleansing block is provided including a solid surfactant and a liquid component, wherein the cleansing block is sticky such that the cleansing block may be attached directly to the surface in a position that is contacted by a rinse liquid that disintegrates the cleansing block. The cleansing block is pressed to the surface above any waterline, and rinse liquid is allowed to contact the cleansing block such that an amount of the cleansing block is mixed with rinse fluid to clean the surface or the liquid reservoir adjacent the surface.

In one version of the method, the cleansing block has a substrate such as a film removably attached to a first surface of the cleansing block, and the substrate is removed from the cleansing block and thereafter the first surface of the cleansing block is pressed to the surface being cleaned. In another version of the method, the cleansing block has a first substrate removably attached to a first surface of the cleansing block and a second substrate removably attached to a second surface of the cleansing block. The first substrate is removed from the cleansing block and thereafter the first surface of the cleansing block is pressed to the surface being cleaned and thereafter the second substrate is removed from the cleansing block. In still another version of the method, the cleansing block has a first substrate removably attached to a first surface of the cleansing block and a second substrate removably attached to a second surface of the cleansing block. A handle is pressed to the first substrate of the cleansing block and the second substrate is removed from the cleansing block. The second surface of the cleansing block is pressed to the surface being cleaned and the handle and first substrate are removed from the cleansing block. In yet another version of the method, a handle is pressed to the cleansing block and thereafter the cleansing block is pressed to the surface being cleaned and thereafter the handle is removed from the cleansing block. In still another version of the method, the cleansing block has a foil or laminate foil pouch used to contain the product which can be cut or torn along the seals allowing the pouch itself to be used as an applicator for the product.

In the method, the surface being cleaned may be an inner surface of a toilet bowl or urinal wherein the rinse fluid is flush water, and the liquid reservoir may be the toilet bowl or urinal. The surface being cleaned may be a window wherein the rinse fluid is rain or water from a hose. The surface being cleaned may be a wall of a shower enclosure or bathtub enclosure wherein the rinse fluid is shower water. The surface being cleaned may be further cleaned by scrubbing with a cleaning implement using the remaining cleansing block after rinse liquid has contacted the cleansing block a plurality of times.

It is therefore an advantage of the invention to provide a self-sticking disintegrating cleansing block having a more linear dissolution rate and more linear actives delivery than prior blocks.

It is another advantage of the invention to provide a self-sticking disintegrating cleansing block having less erosion than prior blocks.

It is yet another advantage of the invention to provide a self-sticking disintegrating cleansing block that is less obtrusive than blocks delivered from a holder dispenser.

It still another advantage of the invention to provide a self-sticking disintegrating cleansing block that may be more conveniently applied to a surface (e.g., toilet bowl) by a user.

It is yet another advantage of the invention to provide a self-sticking disintegrating cleansing block that may be used to clean a toilet bowl or urinal with a cleaning implement towards the end of life of the cleansing block.

It still another advantage of the invention to provide a self-sticking disintegrating cleansing block having less interference during toilet or urinal flushing thereby minimizing reduction of flushing efficiency.

These and other features, aspects, and advantages of the present invention will become better understood upon consideration of the following detailed description, drawings, and appended claims.

BRIEF DESCRIPTION OF THE DRAWINGS

FIG. 1 is a perspective view of a cleaning article according to one embodiment of the invention.

FIG. 2 is a perspective view of a first protective film layer of the cleaning article of FIG. 1 being removed from the cleansing block of the cleaning article by a user's hand.

FIG. 3 is a perspective view of the cleaning article of FIG. 1 (with the first protective film layer removed) being installed under the rim of a toilet bowl by a user's hand.

FIG. 4 is a perspective view of a second protective film layer of the cleaning article of FIG. 1 being removed after the cleaning block has been installed under the rim of a toilet bowl by a user's hand.

FIG. 5 is a perspective view of a cleaning article according to a second embodiment of the invention.

FIG. 6 is a cross-sectional view of a container holding a number of cleaning articles of FIG. 1.

FIG. 7 is a perspective view of a cleaning article according to a third embodiment of the invention.

Like reference numerals will be used to refer to like parts from Figure to Figure in the following description of the drawings.

DETAILED DESCRIPTION OF THE INVENTION

Figure 8A:
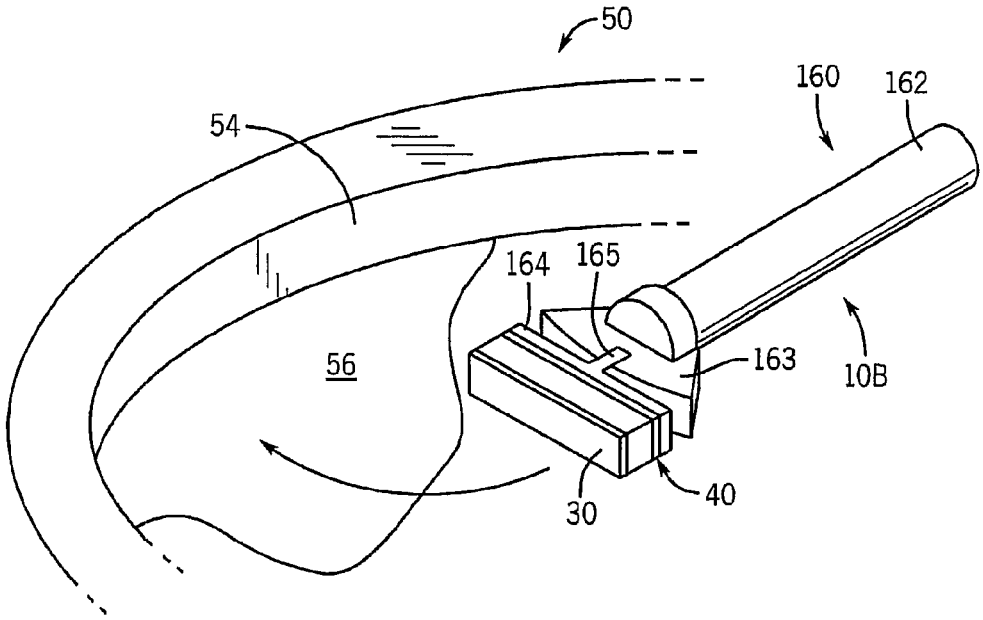
FIG. 8A is a perspective view of a cleaning article according to a fourth embodiment of the invention.

The invention provides a self-sticking cleansing block that disintegrates in a rinse liquid. In an example use of the self-sticking cleansing block, a substrate is provided on the self-sticking cleansing block, and the substrate is removed from the cleansing block and the exposed surface of the cleansing block is pressed to a surface above any waterline in a position that is contacted by a rinse liquid that disintegrates the cleansing block. Rinse liquid is then allowed to contact the cleansing block such that an amount of the cleansing block is mixed with rinse fluid to clean the surface or a liquid reservoir adjacent the surface.

For example, it has been discovered that certain attachable toilet bowl cleaner formulations in the form of disintegrating blocks have the property of sticking to the wall of a toilet bowl or urinal. If properly applied, the disintegrating block will stay in place during normal flushing, and will slowly release active ingredient on an intermittent basis upon flushing of the toilet or urinal so as to provide long-term cleaning and/or disinfection and/or deodorization. No cage or other holder is required. In one form, the disintegrating cleansing block is an extruded disk cut to a predetermined thickness (e.g., approximately one centimeter) such that the cleansing block can be placed onto the toilet or urinal wall simply by pressing on.

Among other things, this invention is a unique development in the under the rim (UTR) toilet bowl-cleaning business. It is a low cost product that is convenient and in many ways environmentally friendly, since the disintegrating cleansing block eliminates the need to use a plastic disposable cage currently used by other UTR products. Furthermore, the disintegrating block of this invention has been found to be long-lasting, such that active ingredient can be released for a period of months (e.g., two months) before the cleansing block disintegrates completely and needs to be replaced with a new cleansing block.

Accordingly, there is provided a disintegrating block to be attached directly to a wall of a toilet bowl or urinal, above the water-line and in the stream of flush water, by pressing the cleansing block to the wall. In one embodiment, the cleansing block includes 25% to 99% of a solid surfactant, and 1% to 25% of a liquid component, wherein all percentages are percent by weight of the total composition of the cleansing block.

The liquid component may selected from water, surfactants, glycerin, fragrances, colorants, alcohols, binders, lime-scale removing agents, hydrotropes, solvents, chelating agents, dispersing agents, and mixtures thereof. The cleansing block may further include a filler. The disintegrating cleansing block should contain proportions of the above-identified ingredients such that the final block is solid and has a mass that has a "sticky" consistency. Preferably, the cleansing block does not flow, i.e., the block is not viscous. The ratio of the two primary ingredients, the solid surfactant and the liquid component, depends on the liquid and its penetration (liquid absorption into the solid) and the solubility of the solid surfactant in the liquid(s). For a liquid fragrance, it is desirable to absorb more than solubilize. Although the addition of water is not preferred, small amounts can be tolerated.

The cleansing block includes one or more solid surfactants, and optionally one or more liquid surfactants. The surfactants may be anionic, nonionic, cationic and/or amphoteric depending on the cleaning properties desired. The cleansing block may include 25-99 wt. % of solid surfactant, preferably 40-95 wt. % of solid surfactant, and most preferably 50-90 wt. % of solid surfactant. The solid surfactant provides adherence to a surface and therefore some level of solid surfactant is preferred to promote adherence. For greater foaming, a higher solid surfactant level may be employed, such as at least 70%. For increased longevity, lower solid surfactant levels, such as 40% and less, may be employed. If present, the liquid surfactant is included in the cleansing block at levels up to 25 wt. %, preferably up to 15 wt. %, and most preferably up to 10 wt. %. Liquid surfactants tend to increase solubility of the block which increases foam and releases more fragrance per flush. (All weight percents are percent by weight of the total cleansing block composition.)

Suitable anionic surfactants include alkali metal salts of alkyl, alkenyl and alkylaryl sulfates and sulfonates. Some such anionic surfactants have the general formula $RSO_4M$ or $RSO_3M$, where R may be an alkyl or alkenyl group of about 8 to about 20 carbon atoms, or an alkylaryl group, the alkyl portion of which may be a straight- or branched-chain alkyl group of about 9 to about 15 carbon atoms, the aryl portion of which may be phenyl or a derivative thereof, and M may be an alkali metal (e.g. sodium, potassium or lithium). As an alternative, M may be a nitrogen derivative (e.g. amino or ammonium). Preferred solid anionic surfactants include sodium lauryl sulfate, sodium lauryl ether sulfate and sodium dodecyl benzene sulfonate. The most preferred solid anionic surfactant is a sodium dodecyl benzene sulfonate sold commercially as "UFARYL" DL85 by Unger Fabrikker, Fredistad, Norway. Another example solid anionic surfactant is powdered sodium lauryl sulfate sold as Stepanol® ME-Dry by Stepan. Another example solid anionic surfactant is powdered sodium ($C_{14}$-$C_{16}$) olefin sulfonate sold as Bio-Terge® AS-90B by Stepan. Other example anionic surfactants are sulfosuccinates.

Useful liquid anionic surfactants can also be added; including but not limited to sodium lauryl ether sulfate, sodium lauryl sulfate, sodium alkyl aryl sulfonate. Although water is not a preferred liquid, it can be added.

Example nonionic surfactants include alkylpolyglycosides such as those available under the tradename GLUCOPON from Henkel, Cincinnati, Ohio, USA. The alkylpolyglycosides have the following formula: $RO—(R'O)_x—Z_n$ where R is a monovalent alkyl radical containing 8 to 20 carbon atoms (the alkyl group may be straight or branched, saturated or unsaturated), O is an oxygen atom, R' is a divalent alkyl radical containing 2 to 4 carbon atoms, preferably ethylene or propylene, x is a number having an average value of 0 to 12, Z is a reducing saccharide moiety containing 5 or 6 carbon atoms, preferably a glucose, galactose, glucosyl, or galactosyl residue, and n is a number having an average value of about 1 to 10. For a detailed discussion of various alkyl glycosides see U.S. Statutory Invention Registration H468 and U.S. Pat. No. 4,565,647, which are incorporated herein by reference along with all other documents cited herein. Some preferred GLUCOPONS are as follows (where Z is a glucose moiety and x=0) In Table A.

TABLE A

| Product | N | R (# carbon atoms) |
|---|---|---|
| 425N | 2.5 | 8-14 |
| 425LF | 2.5 | 8-14 (10 w/w % star-shaped alcohol added) |
| 220UP | 2.5 | 8-10 |
| 225DK | 2.7 | 8-10 |
| 600UP | 2.4 | 12-14 |
| 215CSUP | 2.5 | 8-10 |

Other example nonionic surfactants include alcohol ethoxylates such as those available under the trade name LUTENSOL from BASF, Ludwigshafen, Germany. These surfactants have the general formula $C_{13}H_{25}/C_{15}H_{27}—(OC_2H_4)_n—OH$ (the alkyl group is a mixture of $C_{13}/C_{15}$). Especially preferred are LUTENSOL AO3 (n=3), AO8 (n=8), and AO10 (n=10). Other alcohol ethoxylates include secondary alkanols condensed with ($OC_2H_4$) such as Tergitol 15-S-12, a $C_{11}$-$C_{15}$ secondary alkanol condensed with 12 ($OC_2H_4$) available from Dow Surfactants. Another example nonionic surfactant is polyoxyethylene (4) lauryl ether. Amine oxides are also suitable. An example solid nonionic surfactant is powdered tallow fatty alcohol ethoxylate with 50 moles of EO sold as Genapol T-500P by Clariant. Solid nonionic surfactants may help to control dissolution rates in water and also help adhesion to a surface.

Useful cationic surfactants include, for example, primary amine salts, diamine salts, and quaternary ammonium salts.

Useful amphoteric surfactants include alkyl aminopropionic acids, alkyl iminopropionic acids, imidiazoline carboxylates, alkylbetaines, sulfobetaines, and sultaines.

To achieve adequate density and to keep costs to the minimum, inert filler can be added to the cleansing block. If present, the filler is included in the cleansing block at levels up to 60 wt. %, preferably up to 40 wt. %, and most preferably up to 25 wt. %. Inert salts are preferred such as water-soluble inorganic or organic salts (or mixtures of such salts). Examples include various alkali metal and/or alkaline earth metal sulfates, chlorides, borates, and citrates. Specific inert salts are sodium sulfate, calcium sulfate, sodium chloride, potassium sulfate, sodium carbonate, lithium chloride, tripotassium phosphate, sodium borate, potassium fluoride, sodium bicarbonate, calcium chloride, magnesium chloride, sodium citrate, magnesium sulfate and sodium fluoride.

The cleansing block may include an alcohol. If present, the alcohol is included in the cleansing block at levels up to 25 wt. %, preferably up to 15 wt. %, and most preferably up to 10 wt. %. One preferred alcohol is Neodol 23 marketed by Shell Oil Company. It is a mixture of $C_{12}$ and $C_{13}$ linear primary alcohols. As alternatives, it is believed that any linear (unbranched) primary fatty alcohol of less than $C_{21}$, and greater than $C_8$ (and mixtures thereof) will also be suitable. Examples are 1-dodecanol; EPAL-16 (by Ethyl Corporation) which is a mixture of decanol, dodecanol, tetradecanol, and octadecanol; and ALFOL 1214 (by Vista Chemical Co.) which is a mixture of dodecanol and tetradecanol. Another preferred alcohol is glycerin. The alcohol can help control solution rates in water and help adhesion to a surface.

A fragrance can also be added, depending on the type of aroma that is to be imparted. If present, the fragrance is included in the cleansing block at levels up to 25 wt. %, preferably up to 15 wt. %, and most preferably up to 10 wt. %. For instance, pine, citrus and potpourri scents can be employed. It is especially preferred that such fragrance oils be essentially insoluble in water. Fragrance oils have the added advantage of facilitating extrusion of the cleansing blocks during manufacture.

A colorant is also optionally included in the cleansing block. If present, the colorant is included in the cleansing block at levels up to 10 wt. %. The choice of the colorant will largely depend on the color desired for the water into which the cleansing block composition is to be dispensed.

A binder may be used in the cleansing block to help maintain cleansing block integrity. If present, the binder is included in the cleansing block at levels up to 25 wt. %, preferably up to 15 wt. %, and most preferably up to 10 wt. %. Preferred binders are the hydrated cellulose materials of U.S. Pat. No. 4,722,802, such as hydroxy alkyl cellulose (especially hydroxy ethyl cellulose or hydroxy propyl cellulose). Gum binders may also be used. Examples are guar, xanthan, tragacanth, carrageenan, karaya, or algin.

The cleansing block may include a chlorine releasing agent. If present, the chlorine releasing agent is included in the cleansing block at levels up to 40 wt. %, preferably up to 25 wt. %, and most preferably up to 10 wt. %. Non-limiting examples of a chlorine releasing agent include chloroisocyanuric acids (trichloroisocyanuric acid and dichloroisocyanuric acid), chloroisocyanurates, hypochlorites, chlorosuccinimides, chloramine T (sodium para-toluene sulfochlorine), and halogenated hydantoins (e.g., chlorodimethyl hydantoins).

A lime-scale removing agent may also be present in the cleansing block. If present, the lime-scale removing agent is included in the cleansing block at levels up to 40 wt. %, preferably up to 15 wt. %, and most preferably up to 10 wt. %. Example lime-scale removing agents include, but are not limited to, organic and inorganic acids such as citric acid or sulfamic acid.

A hydrotrope may also be present in the cleansing block to assist in blending of surfactants and other liquids. If present, the hydrotrope is included in the cleansing block at levels up to 25 wt. %, preferably up to 15 wt. %, and most preferably up to 10 wt. %. Example anionic hydrotropes are alkali metal salts of aromatic sulfonates. A preferred hydrotrope is sodium xylene sulfonate such as "Stepanate SXS" available from Stepan Chemicals. Other exemplary hydrotropes include sodium butyl monoglycol sulfate, sodium toluene sulfonate and sodium cumene sulfonate.

A solvent may also be present in the cleansing block to assist in blending of surfactants and other liquids. If present, the solvent is included in the cleansing block at levels up to 25 wt. %, preferably up to 15 wt. %, and most preferably up to 10 wt. %. Example solvents are aliphatic alcohols of up to 8 carbon atoms; alkylene glycols of up to 6 carbon atoms; polyalkylene glycols having up to 6 carbon atoms per alkylene group; mono- or dialkyl ethers of alkylene glycols or polyalkylene glycols having up to 6 carbon atoms per glycol group and up to 6 carbon atoms in each alkyl group; and mono- or diesters of alkylene glycols or polyalkylene glycols having up to 6 carbon atoms per glycol group and up to 6 carbon atoms in each ester group. Specific examples of solvents include t-butanol, t-pentyl alcohol; 2,3-dimethyl-2-butanol, benzyl alcohol or 2-phenyl ethanol, ethylene glycol, propylene glycol, dipropylene glycol, propylene glycol mono-n-butyl ether, dipropylene glycol mono-n-butyl ether, propylene glycol mono-n-propyl ether, dipropylene glycol mono-n-propyl ether, diethylene glycol mono-n-butyl ether, diethylene glycol monomethyl ether, dipropylene glycol monomethyl ether, triethylene glycol, propylene glycol monoacetate, glycerin, ethanol, isopropanol, and dipropylene glycol monoacetate. One preferred solvent is dipropylene glycol.

A chelating agent may also be present in the cleansing block. If present, the chelating agent is included in the cleansing block at levels up to 25 wt. %, preferably up to 15 wt. %, and most preferably up to 10 wt. %. Example chelating agents include ethylenediaminetetraacetic acid (EDTA), trisodium nitrilotriacetate, sodium tripolyphosphate, acrylics, maleic anhydride acrylic copolymers, gluconates, sorbitols, trizaoles, phosphonates, and salts of the foregoing.

The cleansing block may include a dispersing agent such as a polymer selected from the group consisting of a polyacrylic acid and alkali metal salts of polyacrylic acid. If present, the dispersing agent is included in the cleansing block at levels up to 25 wt. %, preferably up to 15 wt. %, and most preferably up to 10 wt. %. The polymer is preferably homopolymer sodium polyacrylate. One version is sold by Rohm & Haas Co. as Acusol 445 ND with a molecular weight of 4,500. Other preferred polymers are potassium polyacrylate and polyacrylic acid itself.

Other additives that can be included in the cleansing block are other cleaning agents (e.g. borax) and preservatives (e.g. Dow Chemical's Dowicil® 75).

One example block includes: (i) 39-86% (preferably 85%) Ufaryl DL 85CJ (solid sodium dodecyl benzene sulfonate 85%), (ii) 0-8% (preferably 8%) Glucopon 425N (nonionic surfactant: an alkylpolyglucoside) surfactant with an alkyl group containing from 8 to 16 carbon atoms and having an average degree of polymerization of 1.6, (iii) 0-6% glycerine 99% (preferably 2%), (iv) 0-50% sodium sulfate (preferably 0%), and (v) 5-8% fragrance (preferably 5%).

Another example block includes: (i) about 35 wt. % powdered nonionic fatty alcohol ethoxylate surfactant; (ii) about 20 wt. % powdered anionic sodium lauryl sulfate surfactant; (iii) about 5 wt. % liquid nonionic alcohol ethoxylate surfactant; (iv) about 39 wt. % citric acid; and (v) about 1 wt. % fragrance.

Yet another example block includes: (i) about 65 wt. % of Ufaryl DL85CJ solid anionic alkyl aryl sulfonate; (ii) about 0.0020 wt % of dye; (iii) about 8.5000 wt % Glucopon 425N nonionic, alkyl polyglycoside; (iv) about 0.5000 wt % glycerine; (v) about 19.9980 wt % sodium sulfate; and (vi) about 6.0000 wt % fragrance.

Still another example block includes: (i) about 65 wt. % of solid anionic sodium lauryl sulfate; (ii) about 0.0020 wt % of dye; (iii) about 8.5000 wt % Glucopon 425N nonionic, alkyl polyglycoside; (iv) about 0.5000 wt % glycerine; (v) about 19.9980 wt % sodium sulfate; and (vi) about 6.0000 wt % fragrance.

The disintegrating blocks of this invention are manufactured using conventional manufacturing methods. For example, the blocks could be formed by melting and casting, or could be formed by extrusion. The ingredients may be mixed together and pressed into a solid product (e.g. by pressure or extrusion). The resulting product is not a gel, i.e., it does not have a viscosity. Preferably, the disintegrating blocks of this invention are manufactured by way of an extrusion process, such as that described in Example 1. During the extrusion process, each time the ingredients forming the disintegrating block are passed through the extruder, the ingredients become mixed more and more uniformly. Generally, the ingredients can initially be passed through the extruder to form fat pieces of spaghetti-like strands of the combined ingredients. Such spaghetti-like strands can then be brought together and extruded into a log having the desired shape such as a 4 cm. diameter cylinder or a ¼ inch (6.35 mm.) thick by ¾ inch (19.05 mm.) wide strip. Once extruded into a log or strip, the log or strip can then be sliced using a flying knife into disks or rectangles of appropriate widths and weight or a cutting wheel for the correct length. While cylindrical disks and rectangles have been described in this paragraph, other shapes are possible. Thus, the invention is not limited to any particular shape of the block.

An important characteristic of the resulting block is that it should adhere to a toilet bowl even after multiple flushes. Although one intended use of this block is toilet cleaning and/or freshening, it is contemplated that this technology could also be used in other applications (e.g., outdoor windows or any other location where water will pass over as a rinse liquid). After a number of toilet flushes, the block dissolves down and when there is not much left, the remainder can be used with a standard toilet brush to clean the toilet.

One can measure how long the block lasts (number of days with a controlled number of flushes/day.) The thickness of the block determines how long it would last, but the softness limits how thin it can be cut (unless it were chilled, e.g., by cold air before cutting). For a fragranced toilet block, it is desirable to have the solubility be such that 0.01 grams of fragrance are released per flush (calculated by dividing the weight of fragrance in the block by the number of flushes required to dissolve the block). It can be beneficial to have the resulting block be very soluble (dissolve readily in the flush water) so it will release more actives and fragrance faster. However, the ratio of ingredients may be modified to achieve the desired solubility. For example, adding more fragrance tends to decrease the solubility so the block lasts longer.

The appropriate percentages to be used for the ingredients of the disintegrating block are dependent, not only on the need for the ultimately-formed disintegrating block to become sticky, but also on the need for the ingredients to be sufficiently moist to pass through an extruder, but not completely wet, so that the disintegrating blocks will retain a block shape and be storable in a dry form. Preferably, the formed blocks are be applied to a removable substrate for convenient storage and application to a surface.

Accordingly, the invention also provides a cleaning article having (i) a sticky cleansing block including a solid surfactant and a liquid component, and (ii) a substrate removably attached to a surface of the cleansing block. In a method according to the invention for using the cleaning article, the substrate is removed from the cleansing block and the exposed surface of the cleansing block is pressed to a surface above any waterline in a position that is contacted by a rinse liquid that disintegrates the cleansing block. Rinse liquid is then allowed to contact the cleansing block such that an amount of the cleansing block is mixed with rinse fluid to clean the surface or a liquid reservoir adjacent the surface.

Turning now to FIGS. 1 to 4, there is shown a first embodiment of a cleaning article according to the invention and one example method for use of the cleaning article. The cleaning article 10 has a cleansing block 20 including a solid surfactant and a liquid component as described above. Any of the formulations described herein are suitable for the cleansing block 20. The cleansing block 20 is shown as a rectangular body in the Figures. However, any shape is possible.

The cleaning article 10 has a first removable substrate 30 adhered to a first surface of the cleansing block 20 and a second removable substrate 40 adhered to an opposed second surface of the cleansing block 20. The first removable substrate 30 and the second removable substrate 40 may be a film layer such as a plastic film layer formed from, but not limited to, a polymer selected from polyethylene, polypropylene, polyethylene terephthalate, polybutylene terphthalate, polyethylene naphthalate, polyesters, polycarbonates, polystyrene, acrylics, polyurethanes, polyvinyl chloride, polyvinyl fluoride, and mixtures and copolymers thereof. It is desirable that less force be required to separate the first substrate from the cleansing block than to separate the second substrate from the cleansing block. If the first substrate 30 includes a release layer 32, then less force may be required to separate the first substrate 30 from the cleansing block 20 than separate the second substrate 40 from the cleansing block 20 so that the first substrate 30 separates first from the cleansing block 20. Silicone is an example material for the release layer 32. Alternatively, the first substrate may be made of an easier release material such as wax paper.

Referring to FIG. 2, the first step in the installation of the cleansing block 20 on a toilet bowl is depicted. A user grasps the first substrate 30 and peels the first substrate 30 away from the cleansing block 20 thereby exposing first surface 22 of the cleansing block 20. Turning to FIG. 3, the user then grasps the second substrate 40 and presses the exposed first surface 22 of the cleansing block 20 against the inner wall 56 of the toilet bowl 50 below the toilet bowl rim 54 in the path of the flush water such that the cleansing block 20 adheres to the inner wall 56 of the toilet bowl 50. Preferably, the cleansing block 20 can be applied even when the inner wall 56 of the toilet bowl 50 is wet. In other words, the cleansing block 20 can be applied when the inner wall 56 of the toilet bowl 50 is wet or dry. However, there is a consumer benefit not to have to dry off the inner wall 56 of the toilet bowl 50 before applying the cleansing block 20. Looking at FIG. 4, the user then peels the second substrate 40 (which has protected the user's hand from contact with the cleansing block 20) away from the cleansing block 20 thereby exposing second surface 24 of the cleansing block 20. When the toilet is flushed, the cleansing block 20 is rinsed with water. This intermittent rinsing of the cleansing block 20 causes the cleansing block 20 to disintegrate slowly and to release active ingredient to the inner surface of the toilet bowl and into the water in the toilet bowl.

Turning to FIG. 5, a second embodiment of a cleaning article 10A is shown. The cleaning article 10A has a first removable substrate 30 adhered to a first surface of the cleansing block 20 as in the cleaning article 10 of FIGS. 1 to 4. The cleaning article 10A also includes a second removable substrate 40*a* adhered to an opposed second surface of the cleansing block 20. The cleaning article 10A also includes a removable handle 60 with a gripping section 62 and an application surface 64. The application surface 64 of the handle 60 is adhered to the second removable substrate 40*a* by way of a suitable attachment means such as a sticky surface of the second removable substrate 40*a* or hook and loop fasteners. A user peels the first substrate 30 away from the cleansing block 20 thereby exposing the first surface of the cleansing block 20. The user grasps the handle 60 and presses the exposed first surface of the cleansing block 20 against the inner wall 56 of the toilet bowl 50 below the toilet bowl rim 54 in the path of the flush water. The user then peels the handle 60 and the second removable substrate 40*a* away from the cleansing block 20 thereby exposing the opposed second surface of the cleansing block 20. When the toilet is flushed, the cleansing block 20 is rinsed with water. This intermittent rinsing of the cleansing block 20 causes the cleansing block 20 to disintegrate slowly and to release active ingredient to the inner surface of the toilet bowl and into the water in the toilet bowl. When the handle 60 is formed from a material such as rubber or hard plastic, more even pressure may be achieved than just using one's fingers to apply the cleansing block 20 to a surface. Alternatively, the handle 60 is formed from a soft, flexible material which can conform to the shape of the object to which the product is being applied. For example, a foam type handle (e.g., formed from a foamed polyurethane or styrene) would permit the handle 60 to conform to the curve of the toilet bowl 50 when applying the cleansing block 20. Optionally, the handle 60 may also be used to pick up a cleansing block 20 without removable substrates and apply the block to a surface.

Referring now to FIG. 6, there is shown a resealable container 70 that is suitable for holding a number of stacked cleaning articles 10 for shipping and storage at a point of purchase. By stacking the cleaning articles 10 with the first substrate 30 and the second substrate 40 of the cleansing block 20 against each other, the cleansing blocks 20 do not stick together. Thus, a user may apply a first cleansing block 20 to a toilet bowl and reseal the remaining cleaning articles 10 in the container 70. When the first cleansing block 20 is used up, a user may grab a second cleaning article 10 from the container 70 and apply it to a surface as described above. Subsequent cleaning articles (e.g. $3^{rd}$, $4^{th}$, $5^{th}$, etc.) may also provided in the container 70 for application to a surface.

Turning to FIG. 7, a third embodiment of a cleaning article 110 is shown. The cleaning article 110 has a first removable wrap 130 adhered to a top surface and all sides of the cleansing block. The cleaning article 110 also includes a removable second substrate 140 adhered to the bottom surface of the cleansing block. A user first peels the wrap 130 away from the cleansing block thereby exposing the first surface of the cleansing block. The user grasps the second substrate 140 and presses the exposed first surface of the cleansing block against the inner wall 56 of the toilet bowl 50 below the toilet bowl rim 54 in the path of the flush water. The user then peels the second substrate 140 away from the cleansing block thereby exposing the opposed second surface of the cleansing block 20. The wrap 130 may include an inner surface release layer such that less force is required to separate the wrap 130 from the cleansing block than separate the second substrate 140 from the cleansing block. Silicone is an example material for the release layer. When the toilet is flushed, the cleansing block 20 is rinsed with water. This intermittent rinsing of the cleansing block 20 causes the cleansing block 20 to disintegrate slowly and to release active ingredient to the inner surface of the toilet bowl and into the water in the toilet bowl. In a related concept, the cleansing block 20 has a foil or laminate foil pouch used to contain the block, and the pouch can be cut or torn along the seals allowing the pouch itself to be used as an applicator for the block 20.

Figure 8B:
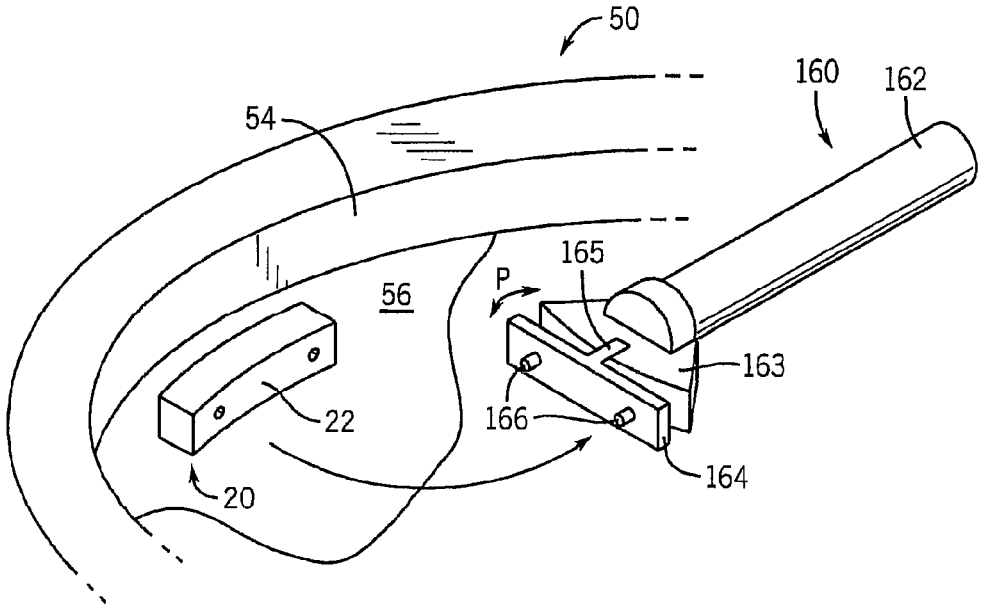
FIG. 8B is a perspective view of a cleaning article of FIG. 8A after the cleansing block has been applied to a toilet bowl.

Referring now to FIGS. 2, 8A and 8B, there is shown a fourth embodiment of a cleaning article 10B. The cleaning article 10B has a first removable substrate 30 adhered to a first surface of the cleansing block 20 and a second removable substrate 40 adhered to an opposed second surface of the cleansing block 20 as in the cleaning article 10 of FIG. 2. The cleaning article 10B also includes a removable handle 160 with a cylindrical gripping section 162 and a fan shaped base 163. An applicator plate 164 is attached to the base 163 by a bar 165 that is perpendicular to the applicator plate 164. The applicator plate 164 can pivot in directions P shown in FIG. 8B. The applicator plate 164 has a pair of outwardly extending spaced apart cylindrical prongs 166.

The user grasps the gripping section 162 of the handle 160 and presses the prongs 166 of the applicator plate 164 into the second removable substrate 40 of the cleansing block 20. The user then peels the first removable substrate 30 away from the cleansing block 20 as shown in FIG. 2 thereby exposing the first surface 22 of the cleansing block 20. The first surface 22 of the cleansing block 20 is then pressed against the inner wall 56 of the toilet bowl 50 below the toilet bowl rim 54 in the path of the flush water. The user then pulls the gripping section 162 and the applicator plate 164 and the second removable substrate 40 away from the cleansing block 20 in a similar manner to that shown in FIG. 4 thereby exposing the first surface 22 of the cleansing block 20 as shown in FIG. 8B. When the toilet is flushed, the cleansing block 20 is rinsed with water. This intermittent rinsing of the cleansing block 20 causes the cleansing block 20 to disintegrate slowly and to release active ingredient to the inner surface of the toilet bowl and into the water in the toilet bowl. When the handle 160 is formed from a material such as rubber or hard plastic, more even pressure may be achieved than just using one's fingers to apply the cleansing block 20 to a surface. The pivoting applicator plate 164 permits the applicator plate 164 to conform to the curve of the toilet bowl 50 when applying the cleansing block 20. Optionally, the handle 160 may also be used to pick up a cleansing block 20 without removable substrates and apply the block to a surface.

While this invention should not be bound by the following theories as to how the disintegrating blocks of this invention work, there are a couple of theories we believe explain the phenomenon. One is that the disintegrating blocks are able to stick to a wall of a toilet or urinal and slowly release active ingredient upon erosion caused by intermittent contact with flush water because of the liquid crystal nature of the blocks when they are exposed to water. Disintegrating blocks of this invention will be dry and sticky upon initial formation, making such blocks easy to store on a substrate. However, upon introducing the disintegrating block into the toilet bowl or urinal, the outside of the block will be moistened by flush water. Prolonged intermittent exposure to flush water will cause the ingredients in the block to stratify, such that the outside of the block becomes water-soluble and the inside of the block remains water insoluble. A liquid crystal will likely form on the outside surface of the block which will lead to the block's continued stickiness and intermittent release of active ingredient. The stickiness of the block may be due to the ability to form agglomerations with minimal energy when wetted with water or another liquid. The liquid component content may be responsible for the block's behavior. When water penetrates the block, a hydrophobic liquid crystal structure is formed. When this occurs, the liquid crystal will become water soluble causing ingredients of the block to solubilize at similar rates. While not wishing to be bound to any theory, it is believed that this effect is due to the formation of protective reverse hexagonal phase liquid crystals when the specified liquids are present in the specified ratios and amounts.

Another theory is that the strength of adhesion between the thin slab of the product and the surface of the toilet bowl is controlled primarily by the magnitude of the inter-molecular forces of attraction between the two systems, i.e., the product and surface of the toilet bowl. The higher the magnitude of this attraction, the greater will be the strength of the adhesion. The magnitude of this attraction will depend upon (1) the nature of the molecules contained within the two systems and (2) the distance between the two systems during use. In general, the closer the two systems are, the greater will be the magnitude of this attraction. In light of the fact that the surface of the toilet bowl is not perfectly smooth, the distance between the two systems can be lowered only by appropriate control of the rheology of the product. In other words, the viscoelastic properties of the product should fall within a certain range for the product to be effective. If the product is not malleable, there will be air gaps between the product and the surface of the toilet bowl, and this will lower the adhesion strength. On the other hand, if the product is too soft, the product can start draining down which will prevent keeping a reasonable volume of the product within a given area on the surface of the bowl. Since the product is essentially solid-like, its viscoelastic properties will be measured using techniques such as a penetrometer and/or appropriate rheometric techniques. Once the viscoelastic properties are determined, a range can be established for the rheology of the product that can lead to good adhesion.

It is therefore another aspect of this invention that the material has a certain hardness or malleability for optimal adhesion to the ceramic or other hard surfaces. Using the "Hardness Test" method below, the hardness should measure between 20 and 160 tenths of a millimeter penetration, and preferably between 50 and 120 tenths of a millimeter penetration, and more preferably between 70 and 100 tenths of a millimeter penetration.

It is also another aspect of this invention that the material has a certain stickiness for optimal adhesion to the ceramic or other hard surfaces. Using the "Stickiness Test" method below, the stickiness of the waxed paper to the cleansing block should measure at least 5 grams, and preferably at least 20 grams, and more preferably at least 40 grams. The stickiness of the cleansing block to the waxed surface should measure at least 50 grams, and preferably at least 60 grams, and more preferably at least 80 grams.

EXAMPLES

The following examples serve to illustrate the invention and are not intended to limit the invention in any way.

Test Methods

1. Hardness Test

The method used to assess the hardness of a cleansing block is the "Hardness Test". The hardness measurement is in tenths of a millimeter penetration into the surface of an extrudate. Therefore, a measurement of 150 is a penetration of 150 tenths of a millimeter, or 15 millimeters. The equipment used was a Precision Penetrometer (Serial #10-R-8, Manufactured by Precision Scientific Co., Chicago, Ill., USA) equipped with a large diameter cone weighing 102.4 grams with a 23D angle, and loaded with 150 grams of weight on the top of the spindle. The test method steps were: (1) Sample must be at least ¼ inch thick. (2) Place sample on the table of the instrument. (3) Both top and bottom surfaces of the test sample should be relatively flat. (4) Set scale on instrument to ZERO and return cone and spindle to the upward position and lock. Clean any residual material off the cone and point before resetting for the next reading. (5) Using hand wheel, lower the complete head of the instrument with cone downward until the point of the cone touches the surface of the sample. (6) Recheck the ZERO and pinch the release of the cone and spindle. (7) Hold the release handle for the count of 10 seconds and release the handle. (8) Read the dial number and record. (9) Repeat steps 4-8 three times at different locations on the surface of the test sample. (10) Add the 3 recorded numbers and divide by 3 for the average. This result is the hardness of the tested sample.

With this "Hardness Test", a higher number indicates a softer product because the units of hardness are in tenths of a millimeter in penetration using the test procedure delineated above. If the cleansing block is too soft (i.e., a high hardness number), then it is difficult to manufacture into shapes such as blocks because the product is too malleable. If the product is too hard (i.e., a low hardness number), then more pressure is required to push the cleansing block onto the surface, and some stickiness is lost. Typically a hardness of about 20 to about 160 tenths of a millimeter penetration is preferred for a cleansing block that will be applied to a dry surface. Typically a hardness of greater than 50 tenths of a millimeter penetration is preferred for a cleansing block that will be applied to a wet surface.

2. Stickiness Test

The method used to assess the level of stickiness of a cleansing block is the "Stickiness Test". The equipment used was: (1) a balance that weighs out to two decimal places and at least 3600 grams; (2) a strip of the product about 0.75 inches wide, 3 inches long, and 0.25 inches thick; (3) a strip of waxed paper about 1 inch wide by 4 inches long; and (4) a 4 inch square ceramic tile. The test method steps were as follows: (1) Take the strip of product and place it on the middle of the weighing plate of the balance. (2) Take the strip of waxed paper and place it on the strip of product. (3) Use your finger or thumb to lightly run over the surface of the waxed paper so it is in contact with the product. (4) Place the tile on top of the waxed paper so that it is centered. (5) Zero the balance and then press slowly and evenly on the tile until 2000 grams of pressure/weight is achieved. (6) Remove the tile, and zero out the balance. (7) Remove the strip of waxed paper from the product, recording the negative weight range achieved during removal. (8) Remove the strip of product from the ceramic tile, recording the negative weight range achieved during removal.

Example 1

The following experiment was conducted to assess the utility of a disintegrating block used as a under-the-toilet-rim-type product by sticking the block directly onto a wall of a toilet bowl. The disintegrating block used in this example was formed by using the following components: (1) Ufaryl DL80CW—50.00 weight %; (2) Sodium Sulfate—38.50 weight %; (3) Neodol 23—5.00 weight %; and (4) Fragrance—6.50 weight %. Dye was also added in a very small amount. Ufaryl DL80 CW is sodium dodecyl benzene sulfonate. Neodol 23 is a 12-carbon and 13-carbon blend of linear fatty alcohols.

All of the above-noted components were mixed until a uniform damp powder or agglomerate mixture was formed. The damp powder was then extruded using a Sigma Lab extruder. The product was passed once through the noodle stage of the extruder, and three times through final extrusion. After the noodle stage, the product came out in the form of spaghetti. After final extrusion, the product was in the form of a very uniform log, with a slight translucent appearance. Extrusion was conducted through a nose cone without the use of a die. Preferably, the extrusion should be conducted without the use of a die smaller than about 1 centimeter in diameter. Following extrusion, the log was cut into disks using a flying knife, such that each disk weighed about 20 to 25 grams.

Once prepared, the performance of the disks formed by the method described above was tested in a toilet bowl. The disk was pressed onto the surface of the inside of the toilet bowl, above the water line. Initial flushing did not cause the disk to fall off. The flushing continued to dissolve the disk. Products were flushed for two weeks, and the product did not fall off during use.

Example 2

Disintegrating blocks were formed using the components listed in the following Tables 1, 2, 3 and 4 wherein all numbers are weight percentages of the total composition of the block. In the Tables, a "yes" under "Stick, wet" or "Stick, dry" indicates that the cleansing block sticks to a wet or dry surface, respectively, upon being pressed firmly to the surface.

TABLE 1

| Component | Formula Number 1 wt. % | 2 wt. % | 3 wt. % | 4 Wt. % | 5 wt. % | 6 wt. % | 7 wt. % | 8 wt. % | 9 Wt. % |
|---|---|---|---|---|---|---|---|---|---|
| Ufaryl DL85CJ anionic alkyl aryl sulfonate | 90 | 90 | 90 | 90 | 90 | 90 | 89 | 88 | 87 |
| Tergitol 15-S-12 nonionic, $C_{11}$-$C_{15}$ secondary alkanol condensed with 12 EO | 2.5 | | | | 2.5 | 5 | | | |
| Glucopon 425N nonionic, alkyl polyglycoside | 2.5 | 2.5 | | 5 | | | 6 | 7 | 8 |
| Acusol 445N Polyacrylate | | 2.5 | 5 | | 2.5 | | | | |
| Fragrance | 5 | 5 | 5 | 5 | 5 | 5 | 5 | 5 | 5 |
| Hardness per the "Hardness Test" (Tenths of a millimeter of penetration) | 44 | 36 | 32 | 46 | 47 | 27 | 54 | 64 | 72 |

TABLE 2

| Component | Formula Number 10 wt. % | 11 wt. % | 12 wt. % |
|---|---|---|---|
| Ufaryl DL85CJ anionic alkyl aryl sulfonate | 90 | 87 | 85 |
| Stepanate - sodium xylene sulfonate anionic hydrotrope | 5 | 8 | 10 |
| Fragrance | 5 | 5 | 5 |
| Hardness per the "Hardness Test" (Tenths of a millimeter of penetration) | 46 | 56 | 62 |

TABLE 3

| Component | Formula Number 13 wt. % | 14 wt. % | 15 wt. % | 16 wt. % |
|---|---|---|---|---|
| Ufaryl DL85CJ anionic alkyl aryl sulfonate | 36 | 39 | 86 | 89 |
| Tergitol 15-S-12 nonionic, $C_{11}$-$C_{15}$ secondary alkanol condensed with 12 EO | 6 | 6 | 6 | 6 |
| Sodium Sulfate filler | 50 | 50 | | |
| Fragrance | 8 | 5 | 8 | 5 |
| Hardness per the "Hardness Test" | 125 | 45 | — | 4 |
| Stick, wet Rectangular Shape | Yes | Yes | dnt | No |
| Stick, dry Rectangular Shape | Yes | Yes | dnt | Yes |

dnt = did not test

TABLE 4

| Component | Formula Number 17 wt. % | 18 wt. % | 19 wt. % | 20 Wt. % | 21 wt. % | 22 wt. % | 23 wt. % | 24 wt. % | 25 wt. % | 26 wt. % |
|---|---|---|---|---|---|---|---|---|---|---|
| Ufaryl DL85CJ anionic alkyl aryl sulfonate | 40 | 40 | 39 | 39 | 39 | 39 | 86 | 85 | 36 | 39 |
| Glucopon 425N nonionic, alkyl polyglycoside | | 2 | | 3 | 1.5 | 6 | 8 | 8 | | |
| Sodium Sulfate filler | 50 | 50 | 50 | 50 | 50 | 50 | | | 50 | 50 |
| Quest Fuzzy Lime fragrance | 8 | 8 | 8 | 8 | 8 | 5 | 5 | 5 | 8 | 5 |
| Hardness per the "Hardness Test" (Tenths of a millimeter of penetration) | 23 | 45 | 47 | 100 | 77 | 48 | 51 | 65 | 157 | 81 |
| Stick, wet Round Shape | dnt | dnt | dnt | dnt | dnt | Yes | Yes | Yes | dnt | dnt |
| Stick, dry Round Shape | Yes | Yes | Yes | Yes | Yes | dnt | dnt | dnt | dnt | dnt |

TABLE 4-continued

| Component | Formula Number 17 wt. % | 18 wt. % | 19 wt. % | 20 Wt. % | 21 wt. % | 22 wt. % | 23 wt. % | 24 wt. % | 25 wt. % | 26 wt. % |
|---|---|---|---|---|---|---|---|---|---|---|
| Stick, wet Rectangular Shape | Yes | Yes | Yes | Yes | Yes | Yes | Yes | Yes | Yes | Yes |
| Stick, dry Rectangular Shape | Yes | Yes | Yes | Yes | Yes | dnt | dnt | dnt | Yes | Yes |
| 10 gm. @ 15 flushes per day Round Shape Life in days | 297 | 297 | >222 | 297 | >481 | >209 | <123 | <194 | dnt | dnt |
| 10 gm. @ 15 flushes per day Rectangular Shape Life in days | >117 | >117 | >117 | >117 | >117 | >209 | <194 | <104 | >225 | >225 |
| 10 gm. @ 24 flushes per day Rectangular Shape Life in days | 241 | | 457 | | 457 | dnt | dnt | Dnt | dnt | dnt |

dnt = did not test

Example 3

Disintegrating blocks were formed using the components listed in the following Table 5 wherein all numbers are weight percentages of the total composition of the block.

TABLE 5

| Component | Formula Number 27 wt. % | 28 wt. % |
|---|---|---|
| Ufaryl DL85CJ anionic alkyl aryl sulfonate | 31.8380 | 61.0000 |
| Dye | 0.0050 | 0.0020 |
| Glucopon 425N nonionic, alkyl polyglycoside | | 7.5000 |
| Glycerine | 1.5000 | 0.5000 |
| Isocer A 04 Paraffin Wax | 4.9747 | |
| Sodium Sulfate filler | 53.7228 | 24.9980 |
| Fragrance | 7.9595 | 6.0000 |
| Hardness per the "Hardness Test" (Tenths of a millimeter of penetration) | 25 | 87 |
| Stickiness per the "Stickiness Test" (Grams) | >50 | >80 |

A "Hardness Test" and a "Stickiness Test" were run with samples prepared using Formula Nos. 27 and 28 to show the hardness and the stickiness. Formula 27 had a hardness rating of 25 tenths of a millimeter of penetration. The range of force to remove the waxed paper ranged from 5 to 20 grams. The range of force needed to remove the product was more than 50 grams as the tray actually lifted away from the balance before it eventually became dislodged. Formula 28 had a hardness rating of 87 tenths of a millimeter of penetration. The range of force to remove the waxed paper ranged from 10 to 40 grams. The range of force needed to remove the product was more than 80 grams as the tray actually lifted even further away from the balance before it eventually became dislodged.

Thus, the present invention provides a self-sticking disintegrating cleansing block that can be directly attached to the wall of a toilet bowl or urinal just above the water-line by pressing the block to the wall of the toilet bowl or urinal. When the toilet or urinal is flushed, the cleansing block is rinsed with water. This intermittent rinsing of the cleansing block causes the cleansing block to disintegrate slowly and to release active ingredient. Despite the intermittent rinsing of the cleansing block, the cleansing block remains firmly attached to the wall, and can remain so attached for several weeks. Eventually, the cleansing block disintegrates completely such that there is no longer a cleansing block on the wall of the toilet bowl or urinal. At this point, one can place a new cleansing block on the wall of the toilet bowl or urinal. While the invention finds particular utility in cleansing a toilet bowl or urinal, it is also useful in cleaning, disinfecting and/or deodorizing any surface that is contacted with a rinse liquid.

While the present invention has been described with respect to what is at present considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent formulations and functions.

INDUSTRIAL APPLICABILITY

The present invention provides low-cost self-sticking disintegrating blocks, for use in toilet bowls or urinals, which can deliver cleaning, disinfecting and/or deodorizing agents directly to the toilet bowl or urinal over an extended period of time. Furthermore, because such blocks are stored in a dry form, they can have a long shelf-life. This invention can be used not only in toilet bowls and urinals, but also in any other reservoirs that provide for periodic flushing by water, and that require the release of an active ingredient on an intermittent and prolonged basis. In certain such contexts, it may be necessary for the block to be much larger than it might be for use in a toilet bowl or urinal.

What is claimed is:

1. A self-sticking cleansing block that disintegrates in a rinse liquid, the block comprising:

25% to 99% of a solid anionic surfactant for providing adherence to a surface; and 1% to 25% of a liquid component, wherein the cleansing block includes a non-ionic surfactant for increasing solubility of the block, wherein the block is not a gel, wherein the cleansing block is sticky such that the cleansing block may be attached directly to the surface in a position that is contacted by the rinse liquid, wherein all percentages are percent by weight of total composition of the cleansing block, wherein the cleansing block has a stickiness as measured in a "Stickiness Test" of at least 50 grams such that the cleansing block can be held against a wall of a toilet or urinal under a flushing rim thereof and above a waterline thereof, by its own stickiness, wherein the cleansing block has a hardness as measured in a "Hardness Test" of greater than 50 tenths of a millimeter of penetration.

2. The self-sticking cleansing block of claim 1 wherein:

the cleansing block comprises 40% to 95% of the solid surfactant.

3. The self-sticking cleansing block of claim 1 wherein:

the cleansing block comprises 50% to 90% of the solid surfactant.

4. The self-sticking cleansing block of claim 1 wherein:

the solid surfactant is selected from the group consisting of alkali metal salts of alkyl, alkenyl and alkylaryl sulfates, alkali metal salts of alkyl, alkenyl and alkylaryl sulfonates, ammonium salts of alkyl, alkenyl and alkylaryl sulfates, and ammonium salts of alkyl, alkenyl and alkylaryl sulfonates.

5. The self-sticking cleansing block of claim 1 wherein:

the solid surfactant is selected from the group consisting of alkali metal salts of alkylaryl sulfonates.

6. The self-sticking cleansing block of claim 1 wherein:

the liquid component is selected from water, surfactants, fragrances, colorants, alcohols, binders, glycerine, chlorine releasing agents, lime-scale removing agents, hydrotropes, solvents, chelating agents, dispersing agents, and mixtures thereof.

7. The self-sticking cleansing block of claim 1 further comprising:

a filler.

8. The self-sticking cleansing block of claim 1 wherein:

the liquid component is a fragrance.

9. The self-sticking cleansing block of claim 1 wherein:

the non-ionic surfactant is a liquid surfactant.

10. The self-sticking cleansing block of claim 1 wherein:

an alcohol is present in the cleansing block at levels up to 25%.

11. The self-sticking cleansing block of claim 10 wherein:

the alcohol is a fatty alcohol.

12. The self-sticking cleansing block of claim 1 wherein:

the cleansing block has a hardness as measured in a "Hardness Test" of less than about 160 tenths of a millimeter of penetration.

* * * * *